US006102405A

United States Patent [19]

Spikes

[11] Patent Number: 6,102,405

[45] Date of Patent: Aug. 15, 2000

[54] TOY CATAPULT AND GAME

[76] Inventor: Michael D. Spikes, 505 SE. Vera Ave., Corvallis, Oreg. 97333-1220

[21] Appl. No.: 09/183,075

[22] Filed: Oct. 30, 1998

Related U.S. Application Data

[60] Provisional application No. 60/064,399, Oct. 30, 1997.

[51] Int. Cl.[7] ..... A63F 9/02

[52] U.S. Cl. ..... 273/405; 273/351

[58] Field of Search ..... 124/4, 6, 7, 16, 124/17, 80, 31, 1; 273/317, 351, 405; 446/429, 430, 473

[56] References Cited

U.S. PATENT DOCUMENTS

| | | | |
|---|---|---|---|
| D. 288,215 | 2/1987 | Tami . | |
| D. 328,764 | 8/1992 | Klitsner . | |
| D. 366,908 | 2/1996 | Crennen . | |
| D. 398,937 | 9/1998 | Spikes . | |
| 1,425,376 | 8/1922 | Ford | 273/405 X |
| 3,638,633 | 2/1972 | Clark . | |
| 3,683,514 | 8/1972 | Hughes | 273/405 X |
| 3,777,733 | 12/1973 | Mitchell | 124/7 |
| 3,841,292 | 10/1974 | Hoffman . | |
| 3,973,774 | 8/1976 | Breslow et al. . | |
| 3,974,820 | 8/1976 | Ott . | |
| 4,052,065 | 10/1977 | Rodriquez . | |
| 4,111,179 | 9/1978 | Hashimoto . | |
| 4,303,247 | 12/1981 | Fain . | |
| 4,411,248 | 10/1983 | Kivenson . | |
| 4,509,760 | 4/1985 | Goldfarb et al. | 273/405 X |
| 4,583,743 | 4/1986 | Macek . | |
| 4,922,884 | 5/1990 | Ford . | |
| 5,299,966 | 4/1994 | Rose, III . | |

*Primary Examiner*—Raleigh W. Chiu
*Attorney, Agent, or Firm*—Kolisch Hartwell Dickinson McCormack & Heuser

[57] ABSTRACT

A toy catapult includes a frame and an elongate arm. One end of the arm includes a wheel that is rotatable on an axis defined by a bar of the frame. The other end of the arm includes a ball holder. An arm-protection member is also circumferentially attached to the arm near its middle. The frame includes dual block members, each having a post member extending vertically from it, and a stop member positioned between the post members. Interposing the block members is a lever arm with a wheel-engagement member for holding the arm in tensed, or cocked position. Tension is caused by a flexible bias member which attaches to the arm and to a hook positioned on the frame and located forward of the wheel.

6 Claims, 4 Drawing Sheets

Fig. 7
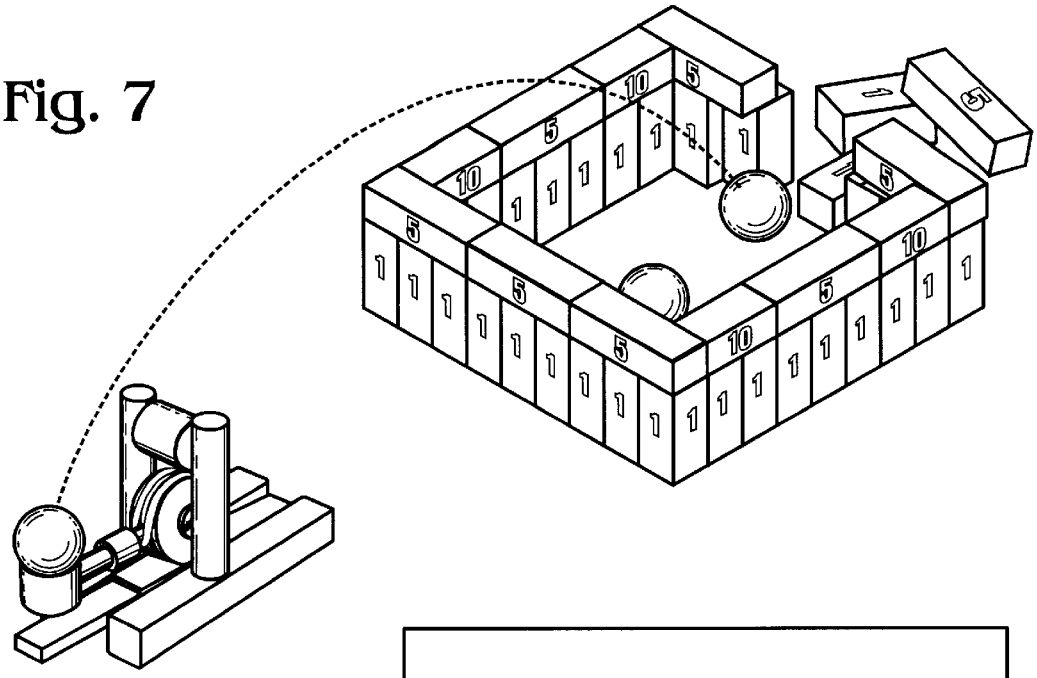
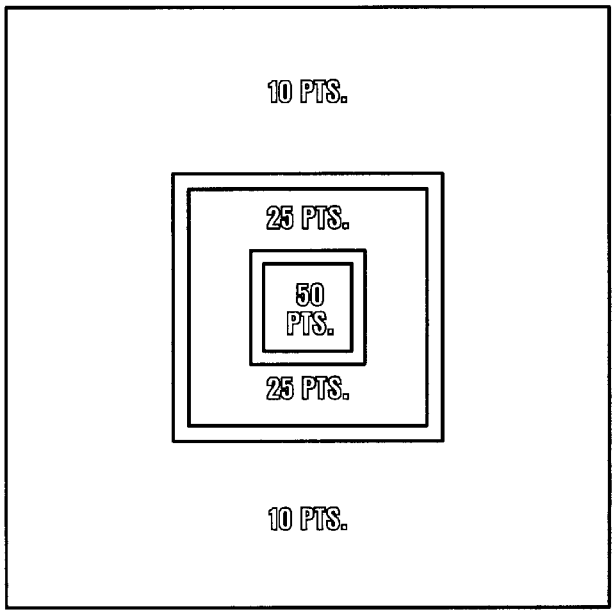
Fig. 8
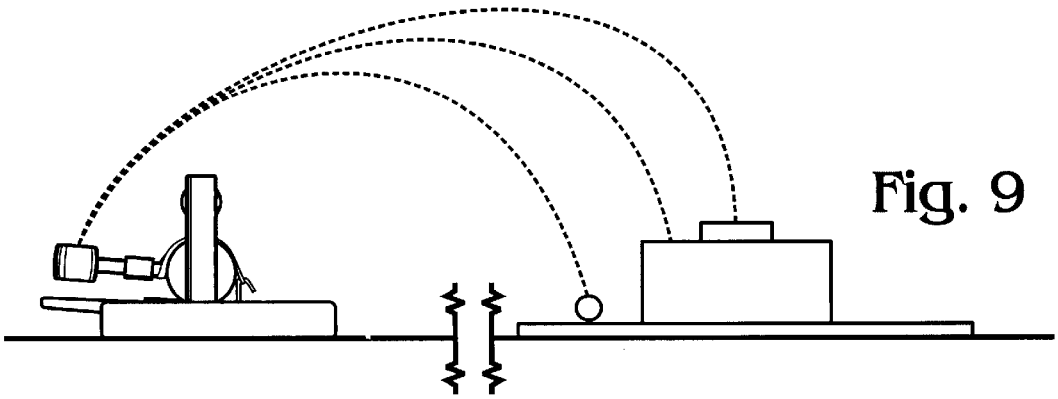
Fig. 9

TOY CATAPULT AND GAME

CROSS-REFERENCE TO RELATED APPLICATIONS

This application claims priority from U.S. Provisional Patent Application Ser. No. 60/064,399 entitled "TOY CATAPULT GAME" which was filed on Oct. 30, 1997.

BACKGROUND AND SUMMARY OF THE INVENTION

This invention relates generally to games, and more particularly to a toy catapult and game.

Various features and other objects and advantages which are attained by the structure and method of the invention will become more fully apparent as the description that now follows is read in conjunction with the several drawing figures, and the attachment that collectively form part of this disclosure.

BRIEF DESCRIPTION OF THE DRAWINGS

FIG. 7 is an isometric view showing how the toy catapult can be used to play a novel game.

FIG. 8 is a top view of a mat used to play the game shown in FIG. 7.

FIG. 9 is a fragmentary side view showing another version of the game shown in FIG. 7.

Attachment A includes a further textual and graphic description of the invention.

DETAILED DESCRIPTION OF THE PREFERRED EMBODIMENT AND THE PREFERRED MANNER OF PRACTICING THE INVENTION

In addition to the following description of the above-identified drawings, the present application also includes attachment A which provides textual and graphic information about the background of the invention, and a further description of the toy catapult, and the game of the invention.

Figure 1:
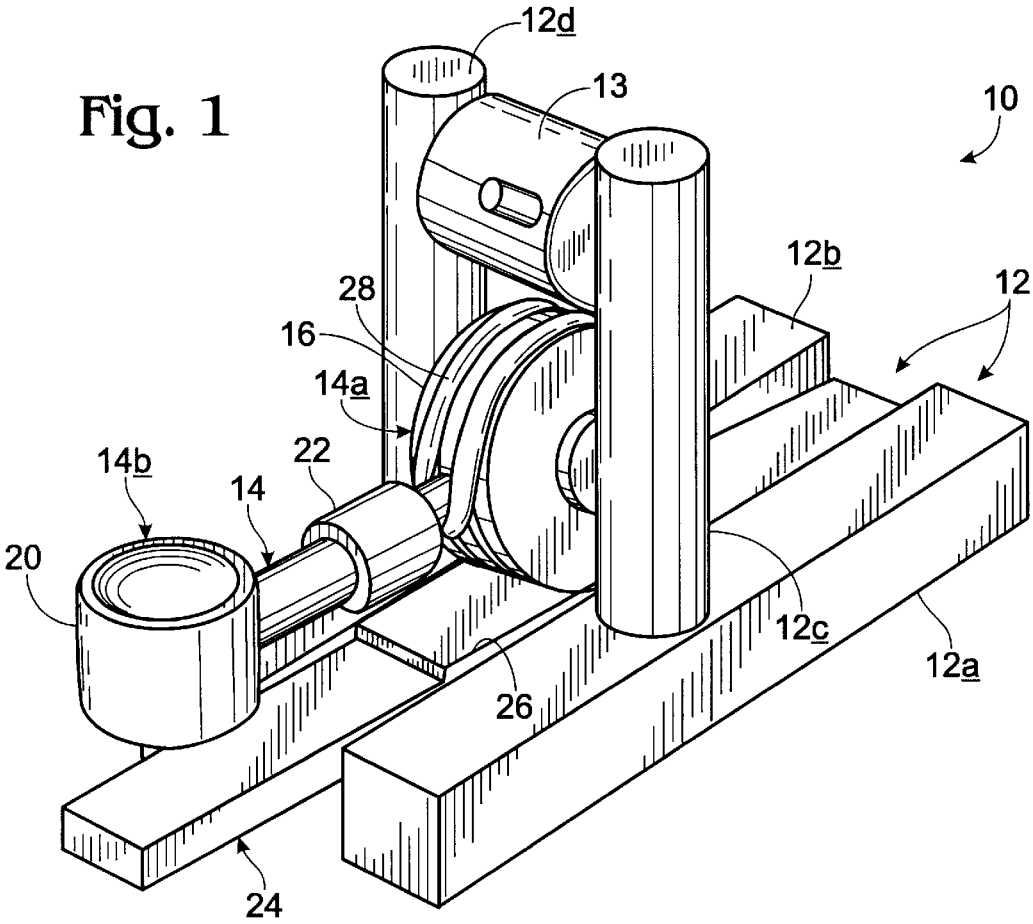
FIG. 1A is an isometric view of an embodiment of the invention.
Figure 6:
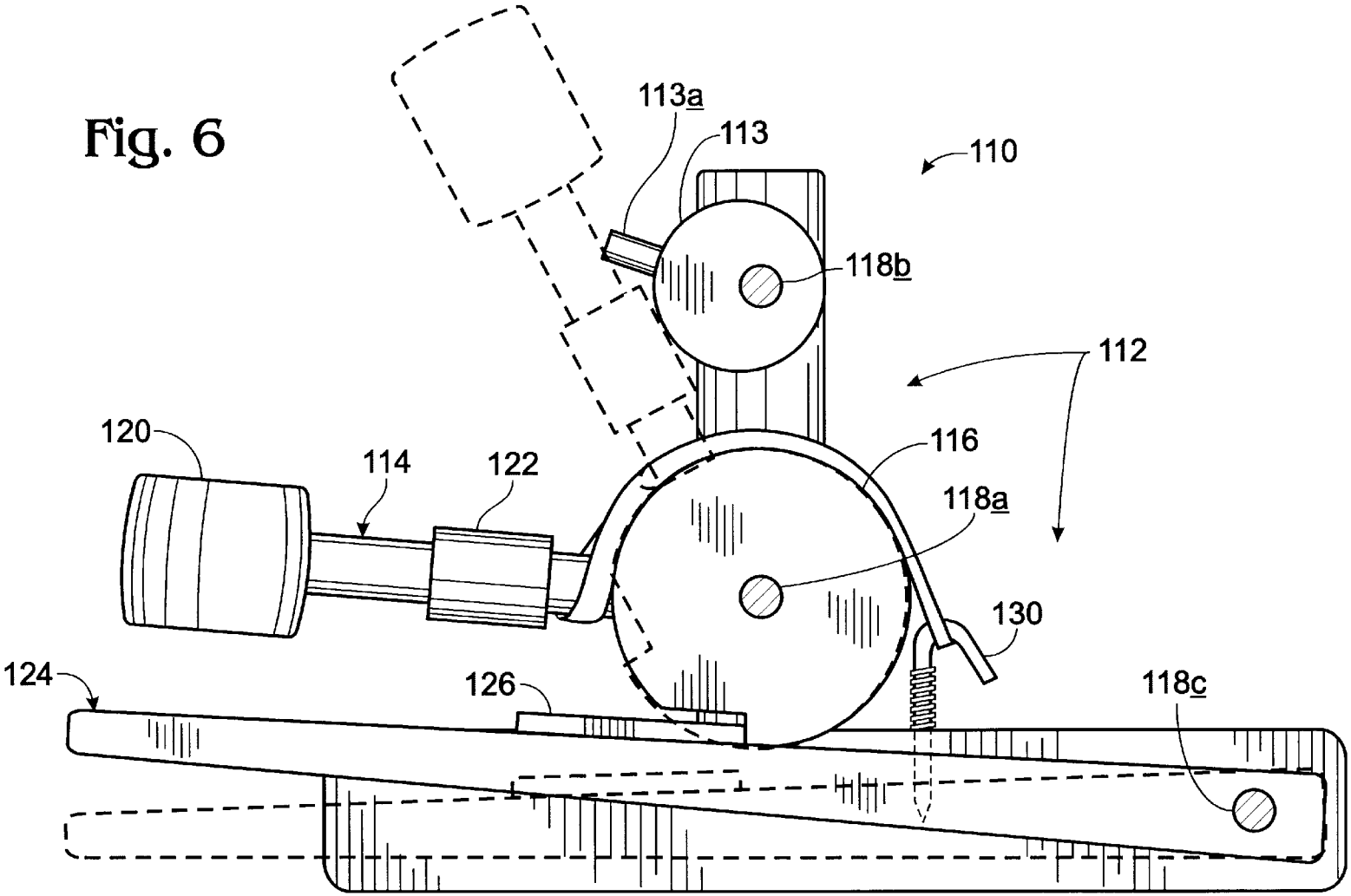
FIG. 6 is a side elevational view like FIGS. 4–5, but on a larger scale, showing a catch mechanism.

Referring to FIG. 1, a toy catapult 10 includes a frame 12 and an elongate arm 14. One end 14*a* of arm 14 includes a wheel 16 that is rotatable on an axis defined by a bar 18*a* (undepicted but like bar 118*a* of FIG. 6) of frame 12. The other end 14*b* of the arm includes a ball holder 20. An arm-protection member 22 is also circumferentially attached to the arm near its middle. Frame 12 includes dual block members 12*a*, 12*b*, each having a corresponding post member 12*c*, 12*d* extending vertically from it. The frame also includes stop member 13 which mounts on bar 18*b* (undepicted but like bar 118*b* of FIG. 6)

Figure 3:
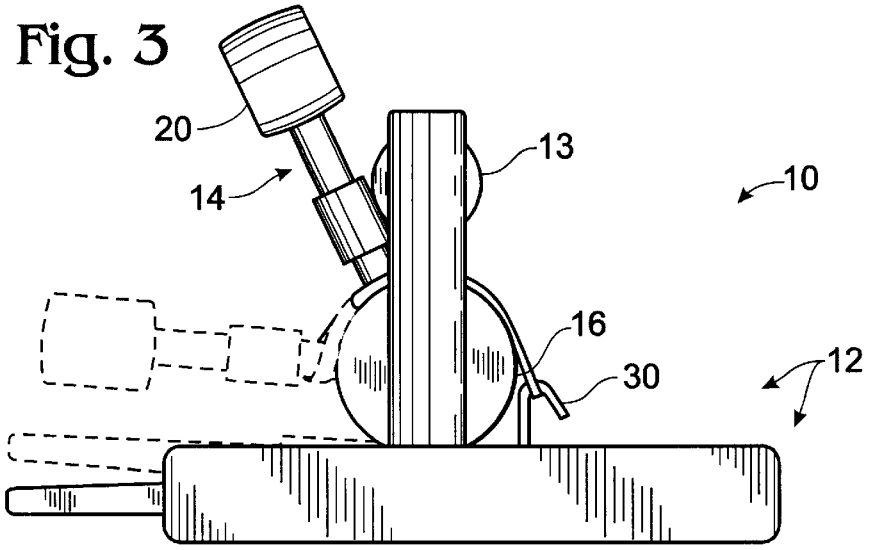
FIG. 3 is a side elevational view of the invention shown in FIG. 1.

Interposing the block members is a lever arm 24 with a wheel-engagement member 26 for holding the arm in tensed, or cocked position. Tension is caused by a flexible bias member, such as a suitable rubber band 28 which attaches to the arm and to a hook 30 (FIG. 3) positioned on the frame and located forward of the wheel. Member 26 engages a suitable, complementary notch formed in a section of wheel 16 (see FIG. 6) so that it is effective to hold arm 14 in the cocked position shown in FIG. 6. Lever arm pivots on an axis defined by bar 18*c* (undepicted but like bar 188*c* shown in FIG. 6). By pressing lever arm 24 downward from a cocked position (see dashed lines in FIG. 3) to a release position (see solid line depiction in FIG. 3), arm 14 will rotate clockwise at a preselected speed until it contacts stop member 13. The preselected force with which arm 14 imparts to stop member 13 will cause a ball resting in ball holder 20 to be thrown a preselected distance.

Figure 2:
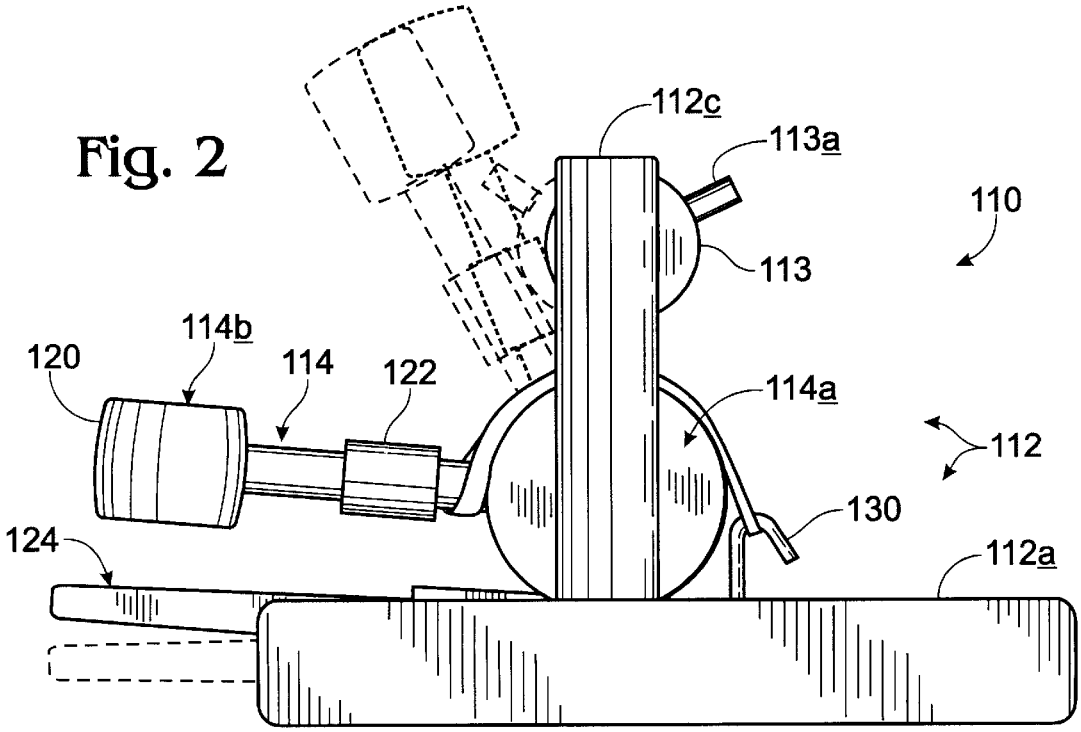
FIG. 2 is a side elevational view of another embodiment of the invention.
Figure 4:
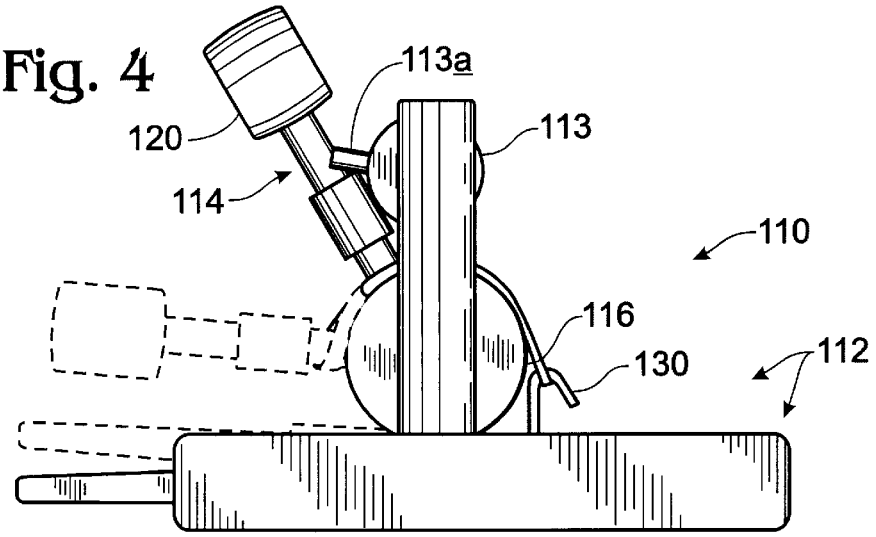
FIGS. 4–5 are side elevational views of the invention shown in FIG. 2, with certain operational features shown.
Figure 5:
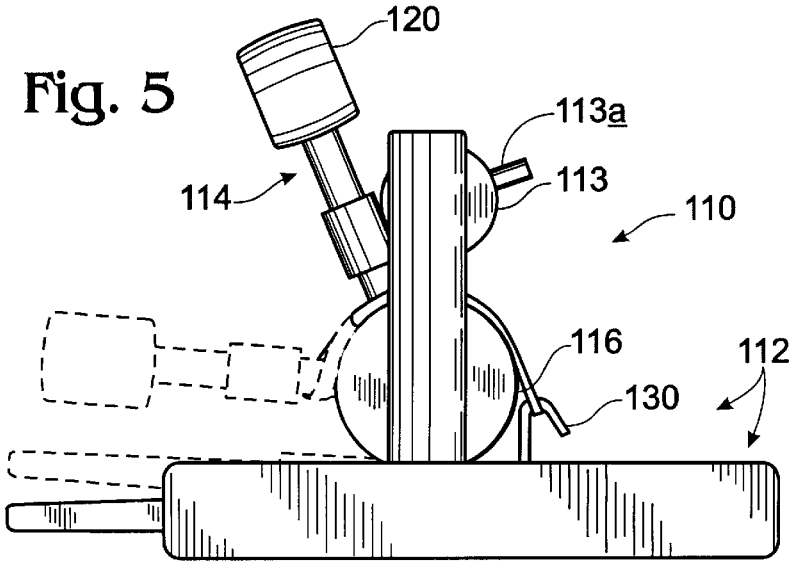

FIG. 2 shows an alternate embodiment of the invention at 110 with an off-axis mounted stop member 113 including a stop-set member 113*a* for setting the stop member at a desired position to change the distance that arm 114 will travel before it contacts stop member 113 (see FIG. 4 (shorter distance) and FIG. 5 (longer distance)). Stop-set member 113*a* is hand manipulable, and stop member 113 rotates freely on bar 118*b* (see FIG. 6).

Attachment A provides further description of the toy catapult with balls that can be thrown using it, and a game that is played with the catapult and a breakable castle made of blocks.

In the present description, it should be understood that any suitable material could be used for the toy catapult, i.e. wood, plastic, etc., and any suitable fastening means could be used to assemble the various components. For the preferred version, it is presently required to allow the wheel, stop and lever to rotate/pivot about their corresponding axes (i.e. see bars 118*a*–118*c* in FIG. 6).

Referring to FIGS. 7–9, the game set includes wooden blocks that are stacked up to form a castle structure that players try to knock down by tossing balls at it with the Catapult Toy. Points are scored by knocking down the various pieces of the castle (see FIG. 7). The game invention could be packaged in a shrink-wrapped cardboard display box printed to look like a castle (undepicted). Inside the box would be placed the Catapult Toy, balls, extra bands, game instructions, etc., and also additional parts to attach to the display box, so it could become the "castle" and target of the game. Points would be scored by hitting the castle with a ball. Alternatively, points could be scored by landing balls within selected areas near the walls of the castle or within the walls of the castle (see FIG. 9). Landing a ball within the central tower would be worth the most points, within the space between the outer walls and central tower would be lesser points and outside but near the castle would be the least points. Referring to FIG. 8, by using a mat made of a suitable material and placing the castle on the mat in an appropriate location, the player will be able to determine the correct number of points scored based upon where the ball lands on the mat.

With respect to the game of the invention, the catapult and castle components are only one example of what could be used. More generally, the game of the invention could involve use of any type of projectile thrower that is capable of throwing projectiles at a structure. The structure is made from plural components that are combinable or stackable, but will break apart, fall apart or otherwise un-combine when the projectile contacts them.

Making the display box itself a component of the castle target (eliminating the expensive blocks) would significantly reduce the costs of the game, and improve the visual appeal of the game. The last page of Attachment A shows an illustration of a version of a packaging box that holds the Catapult and other parts, and demonstrates the idea of the box forming part of the castle. When properly set up, the Castle would have a center tower taller than the outer walls, and also perhaps other Castle parts at each corner.

I claim:

1. A toy target scoring game, comprising:

a toy target structure made of combinable subcomponents, wherein each subcomponent is marked with indicia indicating a value for each subcomponent;

a projectile;

a toy catapult having a frame including a rotational-axis-defining region, an elongate arm with first and second ends and a middle region, the first end being constructed to be rotatable about an axis defined by the rotational-axis-defining region, and the second end being constructed to hold the projectile, and an arm-protection member circumferenfially attached to the arm near the middle region, and a lever arm associated with the frame and including an arm-engagement member for releasably holding the elongate arm in a cocked position; wherein the lever arm is actuable to release the elongate arm from the cocked position to cause the projectile to be thrown from the second end of the elongate arm; and wherein the toy catapult is constructed for selectively throwing the projectile at the toy target structure with a force sufficient to cause at least one subcomponent to separate from the target structure, thereby allowing a score to be calculated each time the toy catapult is used to throw the projectile, with the score being calculated based upon the value of each subcomponent separated from the toy target structure.

2. The game of claim 2 wherein the toy target structure is a castle made from plural, stackable blocks.

3. A toy target scoring game, comprising:

a target structure constructed with an open top and defining plural regions, wherein each region is marked with indicia indicating a value for each region;

a projectile;

a toy catapult having a frame including a rotational-axis-defining region, an elongate arm with first and second ends and a middle region, the first end being constructed to be rotatable about an axis defined by the rotational-axis-defining region, and the second end being constructed to hold the projectile, and an arm-protection member circumferentially attached to the arm near the middle region, and a lever arm associated with the frame and including an arm-engagement member for releasably holding the elongate arm in a cocked position; wherein the lever arm is actuable to release the elongate arm from the cocked position to cause the projectile to be thrown from the second end of the elongate arm; and wherein the toy catapult is constructed for selectively throwing the projectile at the target structure with a force sufficient to allow for the possibility that the projectile will land in one of the regions, thereby allowing a score to be calculated each time the projectile lands in one of the regions, with the score being calculated based upon the value of the region in which the projectile lands.

4. The game of claim 3, further including a mat locatable under the toy target structure, with the mat also being marked with indicia indicating a value for each region, and with the indicia being located on the mat in such a way that the indicia are viewable to define a value for each region when the mat is placed under the toy target structure.

5. The game of claim 3 wherein the toy target structure is a castle.

6. The game of claim 3, further including a display container that is constructed to contain the projectile, toy catapult and part of the toy target structure, and is constructed to be usable as part of the toy target structure.

* * * * *

UNITED STATES PATENT AND TRADEMARK OFFICE

CERTIFICATE OF CORRECTION

PATENT NO : 6,102,405

DATED : August 15, 2000

INVENTOR(S) : Michael D. Spikes

It is certified that error appears in the above-identified patent and that said Letters Patent are hereby corrected as shown below:

Title page, item [54],
after "CATAPULT" delete "AND".

Signed and Sealed this

Seventeenth Day of April, 2001

*Attest:*

Nicholas P. Godici

NICHOLAS P. GODICI

*Attesting Officer*

*Acting Director of the United States Patent and Trademark Office*